US007601035B2

(12) United States Patent
Takahashi et al.

(10) Patent No.: US 7,601,035 B2
(45) Date of Patent: Oct. 13, 2009

(54) CONNECTOR

(75) Inventors: Toshiharu Takahashi, Makinohara (JP); Kazuto Ohtaka, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/245,310

(22) Filed: Oct. 3, 2008

(65) Prior Publication Data

US 2009/0093168 A1 Apr. 9, 2009

(30) Foreign Application Priority Data

Oct. 4, 2007 (JP) ..... 2007-260472

(51) Int. Cl.
*H01R 13/40* (2006.01)

(52) U.S. Cl. ..... 439/733.1

(58) Field of Classification Search ..... 439/488, 439/489, 733.1, 752
See application file for complete search history.

(56) References Cited

U.S. PATENT DOCUMENTS 5,980,325 A * 11/1999 Horchler ..... 439/660
7,153,172 B2 * 12/2006 Milligan et al. ..... 439/752

FOREIGN PATENT DOCUMENTS

JP 2005-166608 A 6/2005
JP 2006-079922 A 3/2006

* cited by examiner

*Primary Examiner*—Khiem Nguyen
(74) *Attorney, Agent, or Firm*—Sughrue Mion, PLLC

(57) ABSTRACT

A terminal receiving member 4 of a connector 1 is attached to a housing 3 to cover an outer surface of the housing 3, with lances 41 inserted in insertion holes 31 of the housing 3. A detection portion 41*a* of each lance 41 inserted in the insertion hole 31 is received in a connection portion receiving portion 21 of a terminal receiving chamber 2. A lance position detection member 5 is mounted on the housing 3 to cover an outer surface of the terminal retaining member 4. The lance position detection member 5 includes housing retaining projections 51 engaged respectively in detection member retaining grooves 35, and lance position detection projections 52 each received between a retaining member retaining portion 34 and a partition wall 33. The lance position detection member 5 is slidable in such a manner that the upward movement of the lance position detection member 5 is limited by engagement of each housing retaining projection 51 with a side surface of the detection member retaining groove 35.

3 Claims, 6 Drawing Sheets

CONNECTOR

BACKGROUND OF THE INVENTION

1. Field of the Invention

This invention relates to a connector provided with a detection member for detecting an insertion position of a terminal within a terminal receiving chamber formed in a housing.

2. Description of the Related Art

One conventional connector of the type described is disclosed in Patent Literature 1 mentioned below. This connector includes a housing having a terminal receiving chamber extending in a forward-rearward direction, and guide grooves are formed respectively in side walls of the terminal receiving chamber, and extend in the forward-rearward direction, and further vertical grooves are formed respectively in these side walls, and extend in an upward-downward direction in intersecting relation to the respective guide grooves. A terminal to be received in the terminal receiving chamber has tongue-like stabilizers extending laterally respectively from opposite sides thereof. A retainer is inserted into the housing from an insertion port formed through a bottom wall of the housing, and a retaining portion and a guide projection of the retainer are disposed in each vertical groove, and are arranged in the upward-downward direction. A gap between the retaining portion and the guide projection is disposed at an intersection portion where the guide groove and the vertical groove intersect each other.

When the terminal is disposed in a proper position within the terminal receiving chamber, each stabilizer is retracted from the intersection portion at which the vertical groove and the guide groove intersect each other. Therefore, the retainer can be pushed into the housing while moving each retaining portion into an upper portion of the vertical groove, and therefore can be completely retained. On the other hand, when the terminal is not disposed in the proper position, each stabilizer is located at the intersection portion at which the vertical groove and the guide groove intersect each other, and the movement of the retaining portion into the upper portion of the vertical groove is prevented by this stabilizer, so that the retainer can not be pushed into the housing, and therefore the retainer remains projected outwardly from the housing, that is, is kept in its provisionally-retained position.

A connector disclosed in Patent Literature 2 mentioned below has reception chambers which are open respectively to side faces of terminal receiving chambers and also are open to a front face of the housing. When a terminal is inserted into the terminal receiving chamber to contact a lance, the lance is elastically bent into the reception chamber to allow the terminal to enter the terminal receiving chamber, and when the terminal is received in a proper position within the terminal receiving chamber, the bent lance is restored to be retracted from the reception chamber. A retainer is attached to the front face of the housing to which the reception chambers are open. More specifically, limitation plates of the retainer are inserted respectively into the reception chambers through openings in the front face of the housing, and by doing so, the retainer is attached to the housing.

When the terminal is not located in the proper position within the terminal receiving chamber, with the lance bent into the reception chamber, the insertion of the limitation plate into the reception chamber is limited or prevented, so that the retainer can not be completely retainingly engaged with the housing. Therefore, the retainer projects outwardly from the housing, and remains in a provisionally-retained condition relative to the housing. On the other hand, when each terminal is located in the proper position within the terminal receiving chamber, with the lance not bent into the reception chamber, the retainer can be brought into completely-retaining engagement with the housing.

Patent Literature 1: JP-A-2006-79922

Patent Literature 2: JP-A-2005-166608

In each of the above conventional connectors, the retainer for confirming the received condition of the terminal is so designed as to be moved perpendicularly relative to the wall surface of the housing, and the retainer in its provisionally-retained condition projects outwardly from the housing, and therefore there was a high possibility that the connector was deformed or damaged when an external force was applied to the projecting retainer.

SUMMARY OF THE INVENTION

With the foregoing in view, it is an object of this invention to provide a connector which will not be deformed or damaged by an external force.

The above object has been achieved by a connector of the present invention characterized in that the connector comprises a housing having an opening through which a terminal receiving chamber is exposed to the exterior, a lance which projects into the terminal receiving chamber and is disposed flush with a wall surface having the opening before the insertion of a terminal into the terminal receiving chamber, and is retracted from the terminal receiving chamber to project from the wall surface when the lance is pressed by the terminal inserted into the terminal receiving chamber, and a detection member which is mounted on the housing to cover the lance so as to move along the wall surface of the housing having the opening, the movement of the detection member being limited by the lance projecting from the wall surface.

Furthermore, the connector of the invention is characterized in that the lance is formed on a terminal retaining member which is separate from the housing and the detection member, and the lance is exposed to the interior of the terminal receiving chamber through the opening.

Furthermore, the connector of the invention is characterized in that the housing or the terminal retaining member has an abutment portion disposed in a path of movement of the detection member, and an engagement portion is formed on the detection member, and can be retained by the abutment portion.

In the present invention, each lance for abutting engagement with the terminal within the terminal receiving chamber is covered with the detection member, and will not project outwardly from the connector, and therefore deformation and damage of the connector due to an external force can be prevented.

BRIEF DESCRIPTION OF THE DRAWINGS

FIG. 4A is the perspective view as seen from the rear side, and FIG. 4B is the horizontal cross-sectional view.

FIG. 5A is the cross-sectional view showing a condition before the insertion, and FIG. 5B is the cross-sectional view showing a condition during the insertion, and FIG. 5C is the cross-sectional view showing a condition after the insertion.

FIG. 6A is the perspective view as seen from the rear side, and FIG. 6B are the horizontal cross-sectional view.

DESCRIPTION OF THE PREFERRED EMBODIMENTS

Figure 1:
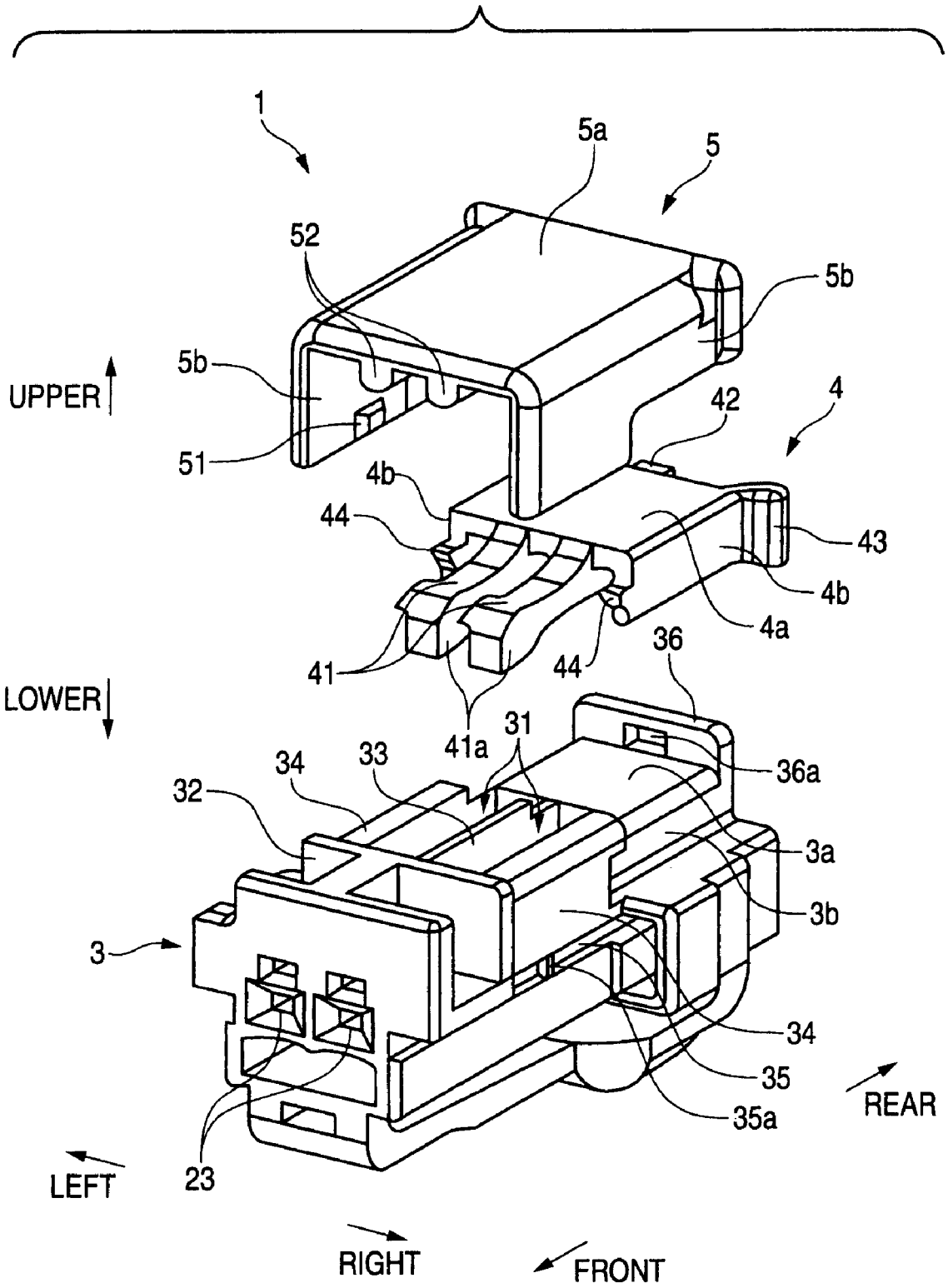
FIG. 1 is an exploded perspective view of one preferred embodiment of a connector of the present invention as seen from the front side.
Figure 2:
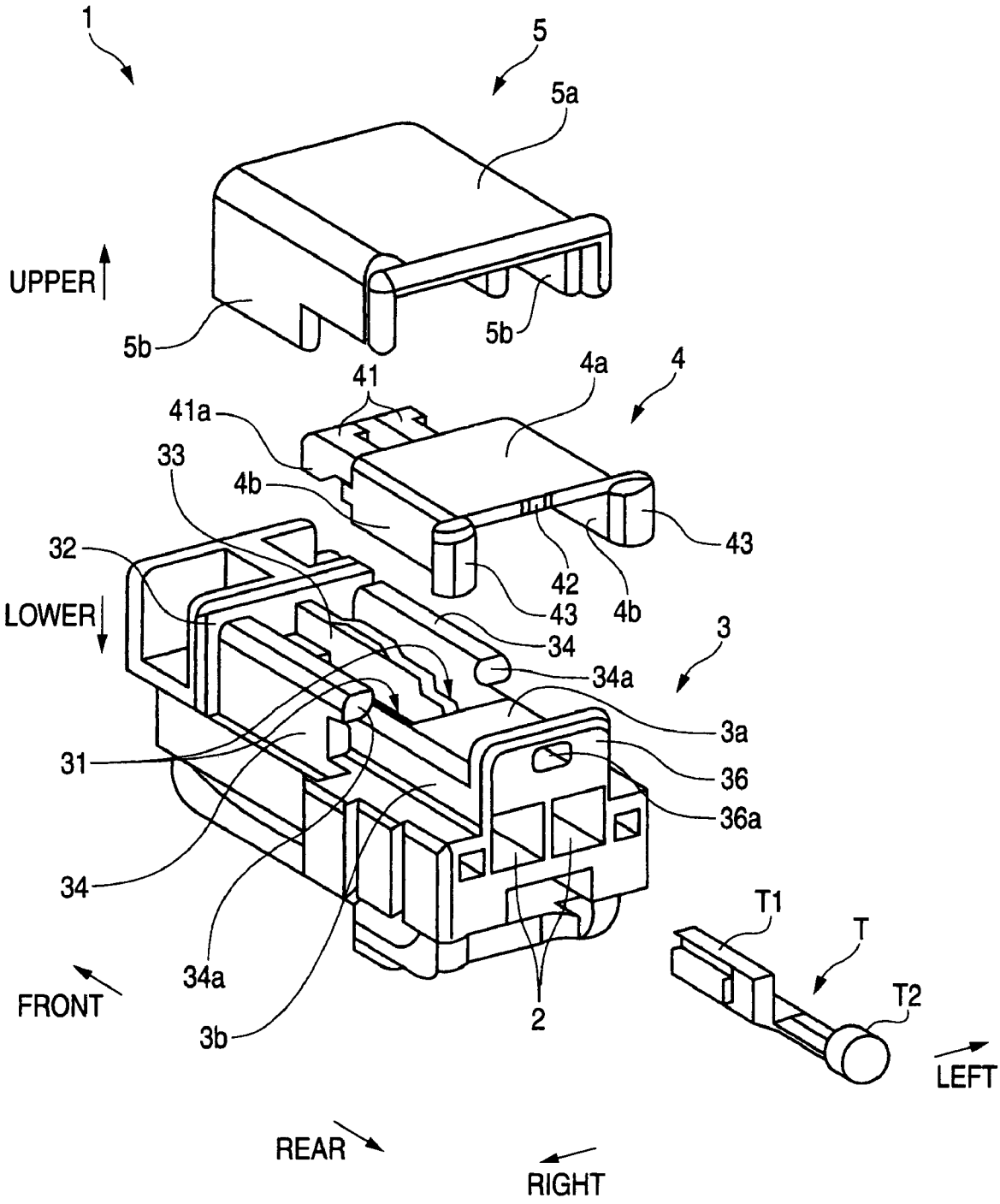
FIG. 2 is an exploded perspective view of the connector as seen from the rear side.
Figure 3:
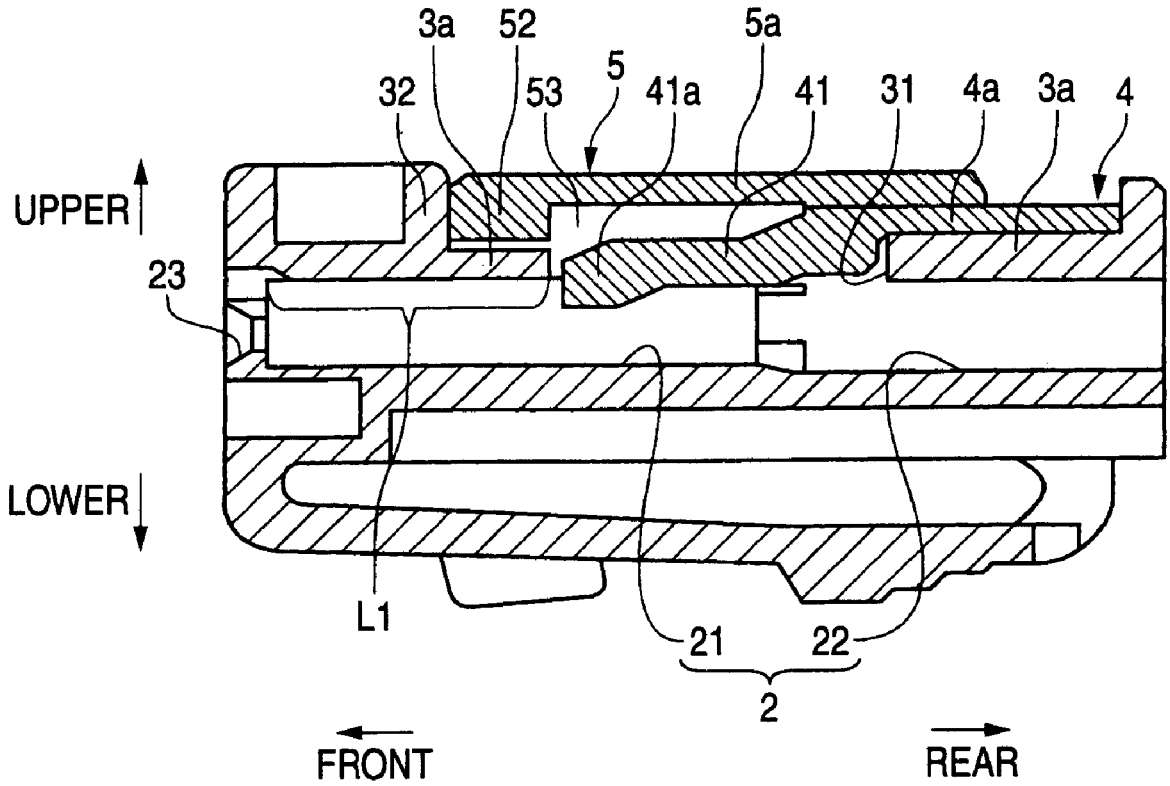
FIG. 3 is a vertical cross-sectional view of the connector.

A preferred embodiment of the present invention will now be described with reference to the drawings. FIG. 1 is an exploded perspective view of a connector 1 of this embodiment as seen from the front side. FIG. 2 is a exploded perspective view of the connector 1 as seen from the rear side. FIG. 3 is a vertical cross-sectional view of the connector 1. The upper, lower, front, rear, right and left sides used in the following description are defined on the basis of the accompanying drawings, and these are defined merely for description purposes, and may, of course, be different from those of an actual connector of the invention.

As shown in FIGS. 1 and 2, the connector 1 comprises a housing 3 having terminal receiving chambers 2, a terminal retaining member 4 attached to the housing 3 to retain terminals T received respectively in the terminal receiving chambers 2, and a lance position detection member 5 for detecting the retaining engagement of the terminal retaining member 4 with the terminals T.

The terminal receiving chambers 2 are open to a rear face of the housing 3. As shown in FIG. 2, each terminal T to be received in the housing 3 has a front half portion serving as a connection portion T1 of a generally square tubular shape, and a rear half portion serving as a press-clamping portion T2 for being press-clamped to an end portion of a wire. The terminal receiving chamber 2 has a square cross-section, and a rear end portion of the terminal receiving chamber 2 is larger in cross-sectional area than a front end portion thereof. The front end portion of the terminal receiving chamber 2 defines a connection portion receiving portion 21 for receiving the connection portion T1, and the rear end portion thereof defines a press-clamping portion receiving portion 22 for receiving the press-clamping portion T2. A connection hole 23 is formed in a front end of the connection portion receiving portion 21, and is formed through a front wall of the housing 3.

As shown in FIGS. 1 and 2, two insertion (intrusion) holes 31 each in the form of a rectangular opening is formed through an upper wall 3*a* of the housing 3, and extend between front and rear end portions thereof. As shown in FIG. 3, the two insertion holes 31 are formed through the upper wall 3*a*, and correspond respectively to the two terminal receiving chambers 2, and each insertion hole 31 extends between a rear end portion of the connection portion receiving portion 21 of the terminal receiving chamber 2 and a front end portion of the press-clamping portion receiving portion 22, so that the interior of the terminal receiving chamber 2 is exposed to the outside of the housing 3. The distance L1 between the front end of the connection portion receiving portion 21 and a front edge of the insertion hole 31 is generally equal to a length L2 (see FIG. 5) of the connection portion T1 of the terminal T.

A movement limitation wall 32 is formed on the upper wall 3*a*, and is disposed forwardly of the insertion holes 31, and is spaced a predetermined distance from the front edges of the insertion holes 31. The movement limitation wall 32 serves to limit the movement of the lance position detection member 5, and extends in a direction (right-left direction) of the width of the upper wall 3*a* of the housing 3 as shown in FIGS. 1 and 2. A partition wall 33 is formed on that portion of the upper wall 3*a* (of the housing 3) disposed between is the two insertion holes 31. This partition wall 33 extends upwardly from the upper surface of the upper wall 3*a*.

A pair of retaining member retaining portions 34 are formed respectively at opposite (right and left) side faces of the housing 3, and extend along the insertion holes 31 from a rear surface of the movement limitation wall 32 to a rear end portion of the insertion hole 31. Each retaining member retaining portion 34 of a generally rectangular block shape is formed in a bulged manner on each side wall 3*b* of the housing 3, and extends from a generally vertically-central portion of the side wall 3*b* to a side edge portion of the upper surface 3*a*. As shown in FIG. 2, retaining portions 34*a* project rearwardly respectively from rear ends of upper edge portions of the two retaining member retaining portions 34. As shown in FIG. 1, detection member retaining grooves 35 are formed respectively in the opposite side walls 3*b* of the housing 3, and are disposed close respectively to lower surfaces of the retaining member retaining portions 34. The detection member retaining grooves 35 extend in the forward-rearward direction (of the housing 3) respectively along the lower surfaces of the retaining member retaining portions 34. A detection member retaining projection 35*a* is formed at a central portion of each detection member retaining groove 35. The detection member retaining projections 35*a* are formed respectively on bottom surfaces of the two detection member retaining grooves 35, and project respectively in right and left directions.

A retaining member retaining portion 36 is formed at the rear end of the housing 3, and extends upwardly from the upper wall 3*a*. The retaining member retaining portion 36 extends along the rear edge of the upper wall 3*a*, that is, in the direction (the right-left direction) of the width of the upper wall 3*a*, and a retaining hole 36*a* is formed through a widthwise-central portion of the retaining member retaining portion 36. The retaining hole 36*a* is formed in a proximal end portion of the retaining member retaining portion 36.

As shown in FIGS. 1 and 2, the terminal retaining member 4 includes an upper wall 4*a* in the form of a rectangular flat plate, and a pair of side walls 4*b* extending downwardly respectively from opposite (right and left) side edges of the upper wall 4*a*, and further a pair of lances 41 are formed on and extend forwardly from a front end portion of the terminal retaining member 4. The upper wall 4*a* has a length generally equal to the distance between the rear surface of the retaining portion 34*a* of each retaining member retaining portion 34 of the housing 3 and the front surface of the retaining member retaining portion 36. The distance between inner surfaces of the right and left side walls 4*b* is generally equal to the width of the upper wall 3*a* of the rear end portion of the housing 3.

A housing retaining portion 42 is formed on and projects rearwardly from a widthwise-central portion of a rear edge of the upper wall 4*a*. Laterally-projecting piece portions 43 project laterally respectively from rear ends of the right and left side walls 4*b*. Each laterally-projecting piece portion 43 extends laterally in a curved manner from the rear end of the side wall 4*b* such that its rear surface is disposed rearwardly of the rear edge of the upper wall 4*a*. Housing retaining portions 44 are formed on and project forwardly from front ends of the two side walls 4*b*, respectively, each housing retaining portion 44 being disposed at a generally vertically-central portion of the front end of the side wall 4*b*.

The pair of lances 41 extend forwardly from an inner surface of the front end portion of the upper wall 4*a*, and are disposed parallel to each other as shown in FIGS. 1 and 2. As shown in FIG. 3, the lance 41 has an intermediate portion which extends from its rear end portion to its central portion (in the forward-rearward direction) and is generally equal in thickness to the upper wall 3*a* disposed at the rear side of the insertion holes 31 of the housing 3, and a lower surface of its front end portion is slanting downwardly, and is disposed at a level lower than a lower surface of its rear end portion. The front end portion of the lance 41 serves as a detection portion 41*a* for detecting an insertion position of the terminal T within the terminal receiving chamber 2. A front surface of the detection portion 41*a* extends from its lower edge to its vertically-central portion generally perpendicularly to the inner surface of the upper wall 4*a*, and then is slanting rearwardly to its upper edge. As shown in FIG. 3, an upper surface of that portion of the lance 41 extending rearwardly from the detection portion 41*a* first extends to the central portion (in the forward-rearward direction) of the lance in parallel relation to the upper surface of the upper wall 4*a*, and then is slanting upwardly to the front end of the upper wall 4*a*.

The terminal retaining member 4 is attached to the housing 3 with the lances 41 received (or inserted) respectively in the pair of insertion holes 31 in the upper wall 3*a* of the housing 3 such that the upper wall 4*a* and the side walls 4*b* cover the upper wall 3*a* and side walls 3*b* of the housing 3, respectively. When the terminal retaining member 4 is thus attached to the housing 3, front edges of the side walls 4*b* abut respectively against the rear surfaces of the retaining portions 34*a* of the retaining member retaining portions 34, and the housing retaining portions 44*a* formed respectively on the opposite side walls 4*b* are retainingly engaged respectively with lower surfaces of the retaining portions 34*a*, and the rear edge of the upper wall 4*a* abuts against the front surface of the retaining member retaining portion 36, and the housing retaining portion 42 formed on the upper wall 4*a* is retainingly engaged in the retaining hole 36*a* of the retaining member retaining portion 36, and therefore the terminal retaining member 4 is fixed to the housing 3. The detection portion 41*a* of each lance 41 (inserted in the insertion hole 31) is received in the connection portion receiving portion 21 of the terminal receiving chamber 2, and the upper surface of each lance 41 lies flush with the upper surface 3*a* of the housing 3 as shown in FIG. 3.

As shown in FIGS. 1 and 2, the lance position detection member 5 has a shape generally similar to the shape of the terminal retaining member 4, and front half portions (front end portions) of opposite (right and left) side walls 5*b* of the lance position detection member 5 extend downwardly beyond rear half portions (rear end portions) thereof. A housing retaining projection 51 is formed on the front end portion of each side wall 5*b* extending downwardly beyond the rear end portion thereof. A pair of lance position detection projections 52 are formed on a front end portion of an upper wall 5*a*. The lance position detection projections 52 are juxtaposed to each other along a front edge of the upper wall 5*a*, and each lance position detection projection 52 has a generally square block shape, and projects inwardly from an inner surface of the upper wall 5*a*.

The lance position detection member 5 is attached to the housing 3 such that the upper wall 5*a* and side walls 5*b* cover the upper wall 4*a*, side walls 4*b* and lances 41 of the terminal retaining member 4 and the retaining member retaining portions 34 of the housing 3. When the lance position detection member 5 is thus mounted on the housing 3, its upper surface 5*a* is disposed flush with the upper ends (or edges) of the movement limitation wall 32 and retaining member retaining portion 36 of the housing 3 (that is, the upper end surfaces of the housing 3) or disposed at a level lower than the upper ends of the movement limitation wall 32 and retaining member retaining portion 36. The lower edge of the front end portion of each side wall 5*b* (extending downwardly beyond the rear end portion thereof) is disposed at a level below the lower end of the retaining member retaining portion 34, and the housing retaining projections 51 are received respectively in the detection member retaining grooves 35. The pair of lance position detection projections 52 formed at the front end portion of the upper wall 5*a* are received respectively in spaces each formed between the partition wall 33 and a respective one of the retaining member retaining portions 34 of the housing 3. The lance position detection member 5 is mounted on the housing 3 to cover the upper wall 4*a* and side walls 4*b* of the terminal retaining member 4, and is slidable in the forward-rearward direction of the housing 3 in such a manner that the upward movement of the lance position detection member 5 is prevented by the housing retaining projections 51 each engaged with a side surface of the detection member retaining groove 35.

Figure 4A:
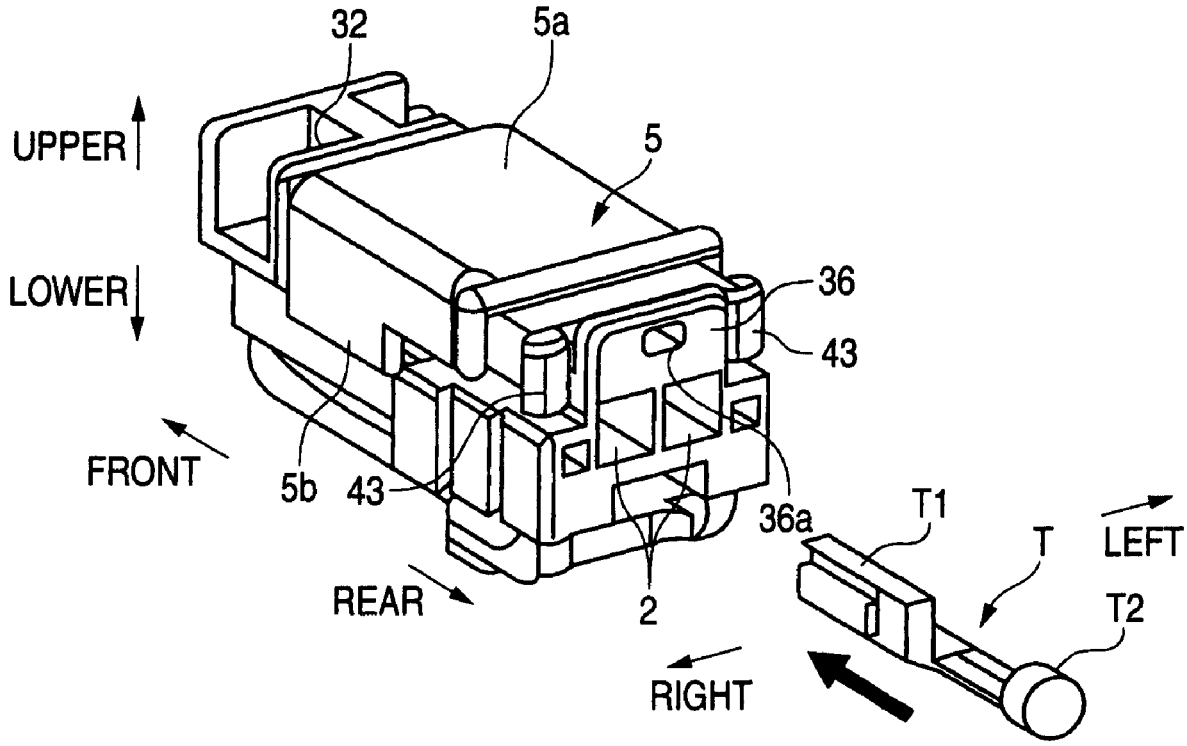
FIGS. 4A and 4B are views of the connector 1, showing a provisionally-retained condition of a lance position detection member.
Figure 4B:
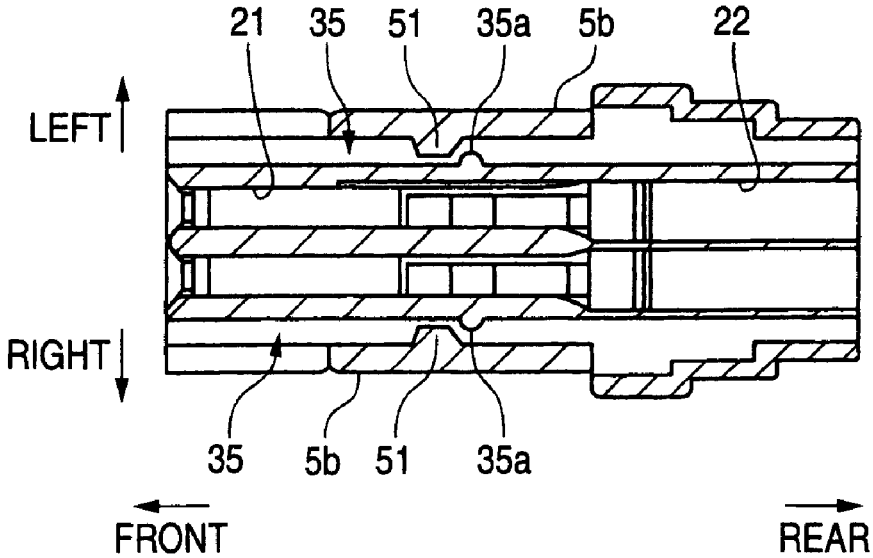
Figure 5A:
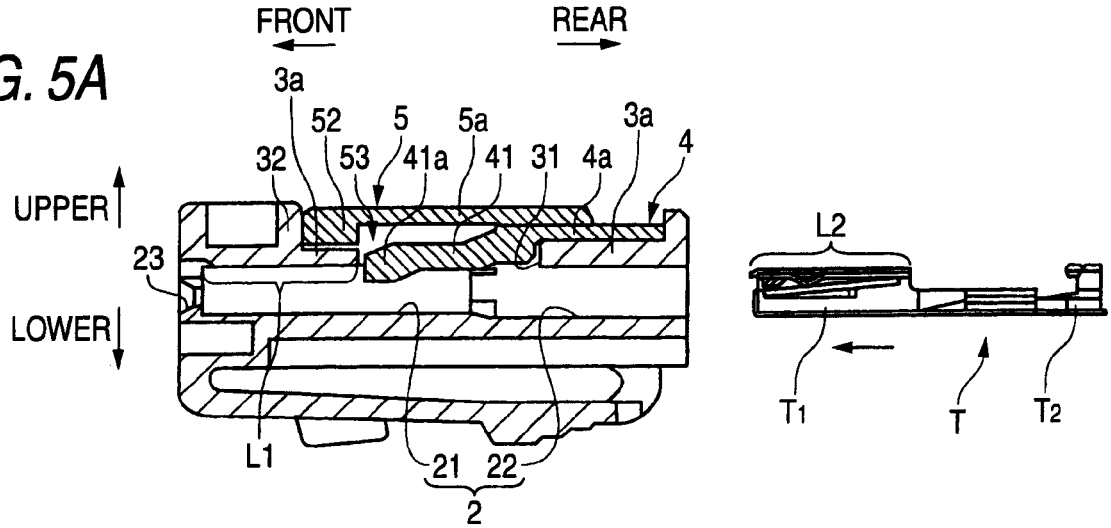
FIGS. 5A to 5C are views explanatory of the relation between a detection operation of a terminal retaining member and the lance position detection member and an insertion position of a terminal.
Figure 5B:
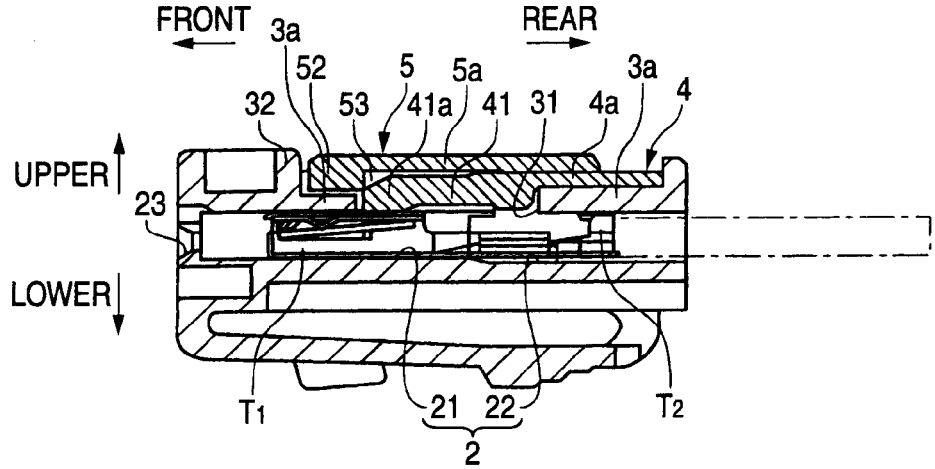
Figure 5C:
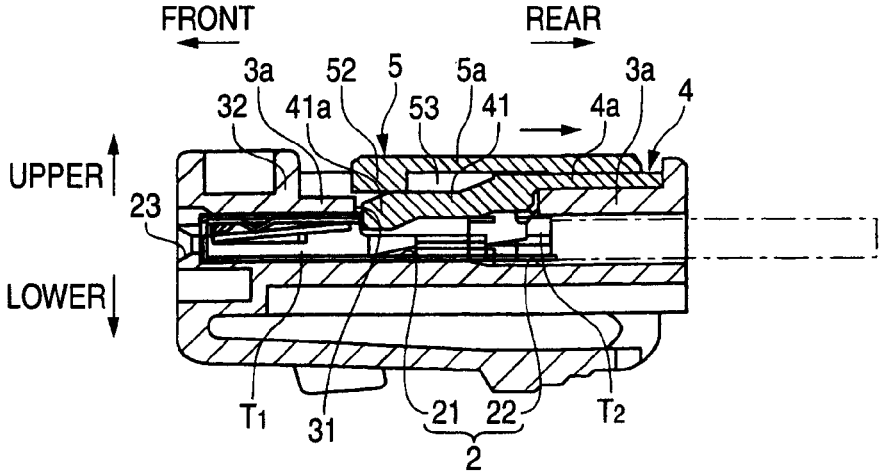
Figure 6A:
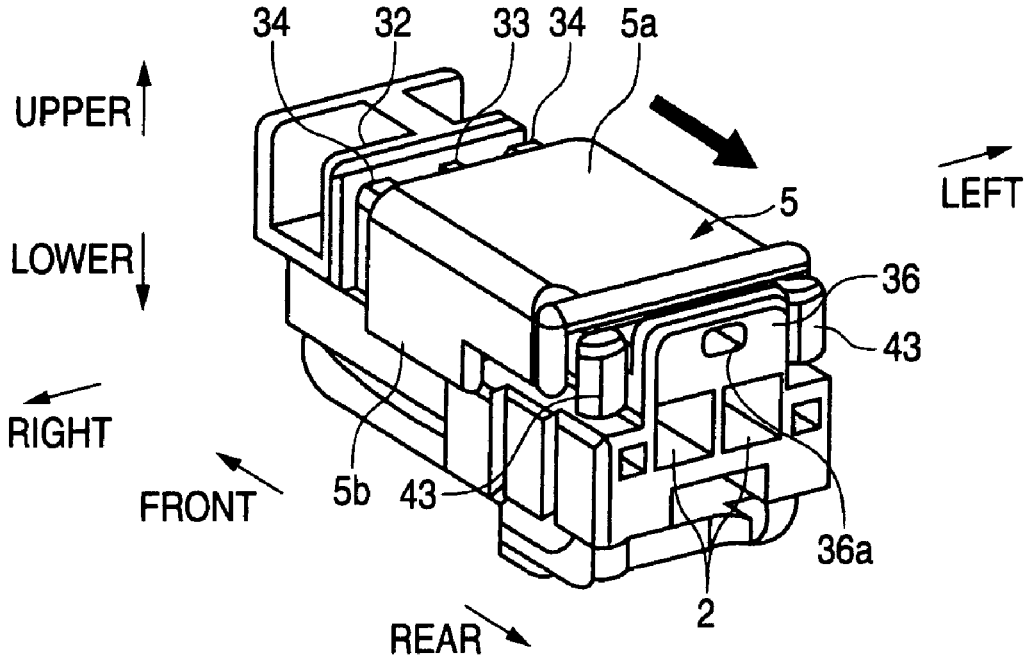
FIGS. 6A and 6B are views of the connector 1, showing a completely-retained condition of the lance position detection member.
Figure 6B:
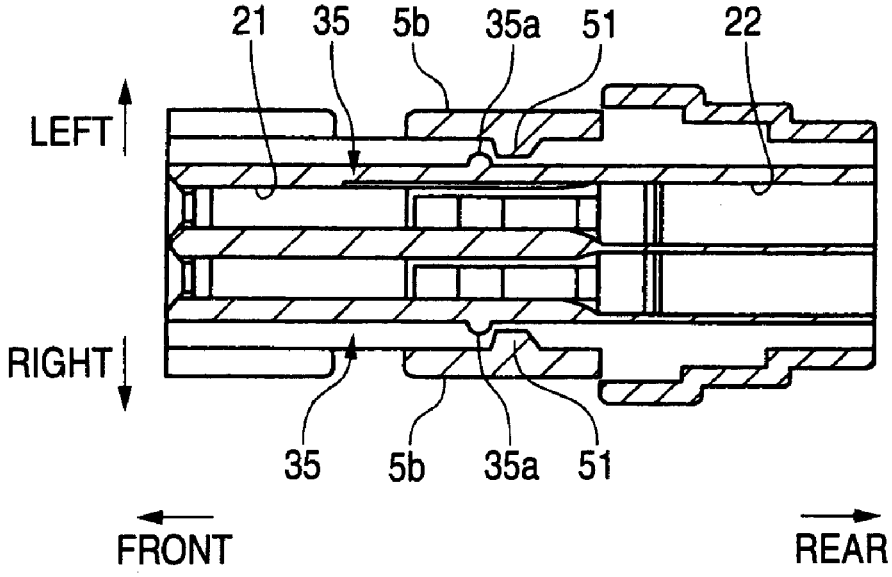

Next, description will be made of the operations of the terminal retaining member 4 and lance position detection member 5 effected when detecting the insertion position of each terminal T in the terminal receiving chamber 2. FIGS. 4A and 4B are views of the connector 1, showing a provisionally-retained condition of the lance position detection member 5, and FIG. 4A is the perspective view as seen from the rear side, and FIG. 4B is the horizontal cross-sectional view. FIGS. 5A to 5C are views explanatory of the relation between the detection operation of the terminal retaining member and the lance position detection member 5 and the insertion position of the terminal T, and FIG. 5A is the cross-sectional view showing a condition before the insertion, and FIG. 5B is the cross-sectional view showing a condition during the insertion, and FIG. 5C is the cross-sectional view showing a condition after the insertion. FIGS. 6A and 6B are views of the connector 1, showing a completely-retained condition of the lance position detection member 5, and FIG. 6A is the perspective view as seen from the rear side, and FIG. 6B are the horizontal cross-sectional view.

Before each terminal T is inserted into the terminal receiving chamber 2, the lance position detection member 5 is moved to the provisionally-retained position (where this detection member 5 is disposed near to the front end of the housing 3) as shown in FIG. 4. In this condition, the front end surface of the lance position detection member 5 abuts against the rear surface of the movement limitation wall 32, and the lance position detection projections 52 overlies that portion of the upper wall 3*a* disposed forwardly of the insertion holes 31 as shown in FIG. 5A. Also, a lower end portion of the detection portion 41*a* of each lance 41 of the terminal retaining member 4 is inserted or received in the terminal receiving chamber 2. Furthermore, each housing retaining projection 51 received in the detection member retaining groove 35 is disposed forwardly of the detection member retaining projection 35*a* as shown in FIG. 4B.

In this condition, when the terminal T is inserted into the terminal receiving chamber 2 from the rear side of the housing 3 as indicated by an arrow in FIG. 4A, the connection portion T1 of the terminal T passes through the press-clamping portion receiving portion 21 into the connection portion receiving portion 22, and is brought into abutting engagement with the slanting lower surface of the detection portion 41*a* of the lance 41. As shown in FIG. 5B, the detection portion 41*a* contacted at its lower surface with the connection portion T1 of the terminal T is displaced (or bent) upwardly as the connection portion T1 advances. The detection portion 41*a* of the upwardly-bent lance 41 is retracted from the terminal receiving chamber 2, and is received in a reception space 53 formed by the rear surface of the lance position detection projection 52 of the lance position detection member 5 and the upper wall 5*a* extending rearwardly from the lance position detection projection 52, and as a result the detection portion 41*a* allows the connection portion T1 to move deeper into the connection portion receiving portion 21. The front surface of the detection portion 41*a* (of the lance 41) received in the reception space 53 is opposed to the rear surface of the lance position detection projection 52 of the lance position detection member 5. Therefore, even when trying to move the lance position detection member 5 rearward, the lance position detection projection 52 abuts against the detection portion 41*a* of the lance 41, thereby limiting or preventing the movement of the lance position detection member 5.

When the terminal T is further inserted into the terminal receiving chamber 2 until the front surface of the connection portion T1 is brought into abutting contact with the front surface of the connection portion receiving portion 21, so that the connection portion T1 is moved generally out of registry with the insertion hole 31 as shown in FIG. 5C, the detection portion 41*a* is moved from the reception space 53 into the insertion hole 31. The detection portion 41*a* received in the insertion hole 31 is retainingly engaged at its front surface with the rear surface of the connection portion T1. As a result, the terminal T is positioned within the terminal receiving chamber 2. Also, the lance position detection projection 52 of the lance position detection member 5 can move over the insertion hole 31, and the limitation of the movement of the lance position detection member 5 is canceled. In this condition, when the lance position detection member 5 is moved toward the rear end of the housing 3 as indicated by an arrow in FIG. 5C, the housing retaining projection 51 of each side wall 5*b* of the lance position detection member 5 is moved rearward in the detection member retaining groove 35, and therefore is brought into abutting engagement with the detection member retaining projection 35*a* of the housing 3, and then slides past this detection member retaining projection 35*a* as shown in FIG. 6B. As a result, the lance position detection member 5 is moved to the completely-retained position (where this detection member 5 is disposed near to the rear end of the housing 3). By confirming the rearward movement of the lance position detection member 5 or the abutting engagement of each housing retaining projection 51 with the detection member retaining projection 35*a*, it can be confirmed that each terminal T has been inserted into the terminal receiving chamber 2 until the front surface of the connection portion T1 has abutted against the front surface of the connection portion receiving portion 21.

In the connector 1 of the above embodiment, the movement of the detection portion 41*a* of the lance 41 in accordance with the movement of the terminal T in the terminal receiving chamber 2 is detected by the lance position detection member 5 moving along the upper surface 4*a* of the terminal retaining member 4. Therefore, the lance position detection member 5, when receiving an external force, is much less liable to be moved between the provisionally-retained position and the completely-retained position. Therefore, an erroneous action of the lance position detection member 5 due to the external force can be prevented. And besides, the lance position detection member 5, together with the terminal retaining member 4, covers the housing 3, and the lance position detection member 5 does not project from the end surfaces of the connector 1, and therefore the erroneous action of the lance position detection member 5 due to the external force can be effectively prevented.

Furthermore, in the connector 1 of the above embodiment, each lance 41 for detecting the insertion of the terminal T into the terminal receiving chamber 2 is cover with the lance position detection member 5, and the detection portion 41*a* displaced upwardly upon contact with the terminal T is received in the reception space 53 formed by the lance position detection projection 52 and the upper wall 5*a* of the lance position detection member 5, and will not project outwardly from the lance position detection member 5. Therefore, the deformation and damage of the lance 41 and its neighboring members as a result of application of an external force to the lance 41 can be prevented, and namely the deformation and damage of the connector 1 can be prevented.

Furthermore, in the connector 1 of the above embodiment, the amount of movement of the lance position detection member 5 between the provisionally-retained position and the completely-retained position is determined according to the mounting positions of the movement limitation wall 32 and the retaining member retaining portion 36 and the length (in the forward-rearward direction) of the lance position detection member 5, and therefore the amount of movement of the lance position detection member 5 can be freely determined without being restricted by the mounting positions of the portions of the connector 1, etc. And besides, the lance 41, when moved to the outside of the insertion hole 31 upon insertion of the terminal T into the terminal receiving chamber 2, is received in the reception space 53 between the lance position detection member 5 and the housing 3, and the lance position detection member 5, while always kept laid on the terminal retaining member 4, slides, and therefore as compared with the case where the lance position detection member 5 is slid in such a manner that the entire surface of the terminal retaining member 4 for detecting the insertion/removal of each terminal T is always exposed to the exterior so as to avoid interference of the lance position detection member with the terminal retaining member 4, the size of the connector 1 in the forward-rearward direction can be reduced by an amount corresponding to the amount of overlapping of the lance position detection member 5 with the terminal retaining member 4.

Furthermore, in the connector 1 of the above embodiment, the lances 41 are formed on the terminal retaining member 4 which is separate from the housing 3. Therefore, in contrast with the case where the lances 41 are formed integrally on the housing 3, the lances 41 can be increased in size without imposing any limitation on the structure of a mold, and the positioning of each terminal T and the detection of the insertion position of the terminal can be effected while keeping the amount of bending of the lance 41 to a low level. Therefore, the retaining of the terminal T and the lance position detection projection 52 by each lance 41 will not be canceled by an external force acting on the terminal T and the lance position detection projection 52, and the positioning of each terminal T and the detection of the insertion position of the terminal within the terminal receiving chamber 2 can be positively effected, using only the lance 41. Therefore, as compared with the case where the positioning of the terminal T within the terminal receiving chamber 2 and the detection of the insertion position of the terminal T within the terminal receiving chamber 2 are effected respectively by the use of different members, the overall size of the connector 1 can be made smaller, and the production cost can be reduced. And besides, merely by canceling the retaining of the terminal T by the lance 41, the terminal T can be removed from the terminal receiving chamber 2, and therefore the operation for removing the terminal T as well as the operation for exchanging the terminal T can be carried out easily.

In the above embodiment, the lances 41 are formed on the terminal retaining member 4 interposed between the housing 3 and the lance position detection member 5, and are separate from the housing 3. However, the lances 41 may be formed integrally on the housing 3. Further, in the above embodiment, the upper portion of the front surface of the detection portion 41*a* of the lance 41 is slanting rearwardly so as to avoid the retaining engagement of the detection portion 41*a* with the lance position detection projection 52 of the lance position detection member 5. However, if the detection portion 41*a*, when retainingly engaged with the terminal T, is not retainingly engaged with the lance position detection projection 52, the upper portion of the front surface of the detection portion 41*a* does not always need to be slanting rearwardly, and the detection portion 41*a* may have, for example, a square block shape.

In the above embodiment, the housing 3 has the two terminal receiving chambers 2, and therefore the terminal retaining member 4 has the two lances 41. However, the number of the lances 41 of the terminal retaining member 4 can be suitably changed according to the number of the terminal receiving chambers 2 of the housing 3. Furthermore, the lance 41 can have any suitable shape in so far as the lance 41 projects into the terminal receiving chamber 2 through the insertion hole 31, with its upper surface disposed flush with the upper surface 3*a* of the housing 3, and can be forced out of the insertion hole 31 by the terminal T moving in the terminal receiving chamber 2, so as to limit the movement of the lance position detection member 5.

The lance position detection member 5 can have any suitable shape in so far as it is mounted on the housing 3 to cover the lances 41, and can move along the wall surface of the housing 3, and the movement of the lance position detection member 5 is limited by the lances 41 moved outwardly from the respective insertion holes 31. In the above embodiment, although the lance position detection member 5 has a generally U-shaped cross-section, it does not always need to have such a U-shaped cross-section. Furthermore, the lance position detection member 5 may be provided for each terminal receiving chamber 2 or for a plurality of terminal receiving chambers 2. Furthermore, there can be provided a construction in which the movement of the lance position detection member 5 from a provisionally-retained position (at the rear end side of the housing 3) to a completely-retained position (at the front end side of the housing 3) is limited by the lances 41.

What is claimed is:

1. A connector, comprising:

a housing having an opening through which a terminal receiving chamber is exposed to the exterior;

a lance projecting into said terminal receiving chamber and disposed flush with a wall surface having said opening before the insertion of a terminal into said terminal receiving chamber, and retracted from said terminal receiving chamber to project from said wall surface when said lance is pressed by said terminal inserted into said terminal receiving chamber; and a detection member mounted on said housing to cover said lance so as to move along the wall surface of said housing having said opening, the movement of said detection member being limited by said lance projecting from said wall surface.

2. The connector according to claim 1, wherein said lance is formed on a terminal retaining member which is separate from said housing and said detection member, and said lance is exposed to the interior of said terminal receiving chamber through said opening.

3. The connector according to claim 2, wherein said housing or said terminal retaining member has an abutment portion disposed in a path of movement of said detection member, and an engagement portion is formed on said detection member, and can be retained by said abutment portion.

* * * * *